US005787747A

United States Patent [19]

Bevk et al.

[11] Patent Number: 5,787,747

[45] Date of Patent: Aug. 4, 1998

[54] PROCESS AND APPARATUS FOR MAKING IN-SITU-FORMED MULTIFILAMENTARY COMPOSITES

[75] Inventors: Joze Bevk, Summit; Gregory S. Boebinger, Westfield; A. Passner, East Brunswick, all of N.J.

[73] Assignee: Lucent Technologies, Inc., Murray Hill, N.J.

[21] Appl. No.: 919,440

[22] Filed: Aug. 27, 1997

Related U.S. Application Data

[63] Continuation of Ser. No. 612,701, Mar. 8, 1996, abandoned.

[51] Int. Cl.[6] ..... B21C 9/00

[52] U.S. Cl. ..... 72/16.5; 72/18.3; 72/286

[58] Field of Search ..... 72/286, 289, 18.3, 72/16.5

[56] References Cited

U.S. PATENT DOCUMENTS

| | | | |
|---|---|---|---|
| 3,577,761 | 5/1971 | Monestam | 72/260 |
| 4,329,539 | 5/1982 | Tanaka | 174/128 S |
| 4,820,896 | 4/1989 | Weil | 219/83 |
| 4,883,545 | 11/1989 | Matlock | 148/12 B |

OTHER PUBLICATIONS

Bevk et al., "High Temperature Strength and Fracture Mode of In Situ Formed Cu–Nb Multifilamentary Composites," in New Developments and Applications in Composites, Symposium Proc. TMS–AIME Physical Metallurgy and Composites Committees at the TMS–AIME Fall Mtg. St. Louis, Missouri, Oct. 16–17, 1978, pp. 101–113.

Bevk et al., "Anomalous Increase in Strength of In Situ Formed Cu–Nb Multifilamentary Composites," J. Appl. Phys., 49(12), pp. 6031–6038, Dec. 1978.

Karasek et al., "Normal–State Resistivity of In Situ–Formed Ultrafine Filamentary Cu–Nb Composites," J. Appl. Phys., 52(3), pp. 1370–1375, Mar. 1981.

Bevk, "Ultrafine Filamentary Composites," Ann. Rev. Mater. Sci., V.13, pp. 319–338, 1983.

Boebinger et al., "Building World–Record Magnets," Sci. Amer., 272(6), pp. 34–40, Jun. 1995.

*Primary Examiner*—Daniel C. Crane

[57] ABSTRACT

Methods and apparatus are disclosed for maximizing the strength and deformability of dimensionally-reduced in-situ-formed composites. According the invention, the temperature of the composite is maintained at less than its recrystallization temperature as it is dimensionally reduced, such as by drawing it through one or more dies in a wire-drawing apparatus. The drawing speed and other parameters may be adjusted, as required, to control composite temperature.

27 Claims, 6 Drawing Sheets

PROCESS AND APPARATUS FOR MAKING IN-SITU-FORMED MULTIFILAMENTARY COMPOSITES

"This application is a continuation of application Ser. No. 08/612,701, filed Mar. 8, 1996, now abandoned."

FIELD OF THE INVENTION

The present invention relates to in-situ-formed multifilamentary composites. More particularly, the present invention relates to a process for maximizing the strength and deformability of such composites as they are reduced in size to form wires and the like.

BACKGROUND OF THE INVENTION

In some processes for manufacturing copper-based wire, the wire is drawn through a series of successively smaller dies. The wire heats up as it is drawn through the dies. Such heating is due to the friction that results as the wire passes through the die and also to work hardening or the strengthening of the wire due to dislocation formation. Dislocations are thermodynamically unstable defects in the crystal lattice that increase the strength of the wire. Such disclocations are formed as the wire's cross-sectional area is reduced. Due to the instability of the dislocations, two neighboring dislocations can annihilate each other. If the dislocations are mobile within the wire, which they are in conventional materials, the annihilation process is accelerated. Dislocation annihilation is promoted by heating the wire. The annihilation process reduces the total number of dislocations in the drawn wire thereby weakening the wire. For conventional copper-based alloys and composite wires, the speed at which the wire is drawn through the dies ("drawing speed") is typically not limited by the heating of the wire that occurs as described above. While such heating may have some effect on mechanical properties, such effects are usually inconsequential in terms of the wire's intended use. As wire manufacturers seek to maximize production, the typically inconsequential effects on wire properties favor maximizing the drawing speed. The drawing speed is limited, however, by frictional forces. As the drawing speed increases, the force required to overcome frictional forces on the wire increases. Above a maximum drawing speed, the wire will break because the force required to overcome the friction exceeds the strength of the wire. Thus, manufacturing processes for typical copper wire seek to maximize the drawing speed to achieve a high throughput, subject only to the aforementioned strength limit. Such an approach may lead to problems, however, when dimensionally reducing a certain class of materials into wire or the like, as described below.

SUMMARY OF THE INVENTION

It has been discovered that for a class of materials known as in-situ-formed composites, the mechanical properties of such composites, after size reduction, can be dramatically affected by the rate of size reduction.

In-situ-formed composites, notable for their high strength, are characterized by the presence of a dense distribution of submicron filaments of one material within a matrix formed of another material. When such a composite dimensionally reduced, for example, by being drawn through a die, the filaments become exceedingly fine, retarding the movement of dislocations within the matrix of the other material. Dislocation annihilation is therefore suppressed, yielding a much higher strength compared to conventional materials.

See Bevk, J., "Ultrafine Filamentary Composites," Ann. Rev. Mater. Sci. 1983, 13:319–338; Karasek et al., "Normal-State Resistivity of In-Situ-Formed Ultrafine Filamentary Cu-Nb Composites," 52(3) J. Appl. Phys., March 1981, 1370–1375; Bevk et al., "Anomalous Increase in Strength of In-Situ Formed Cu-Nb Multifilimentary Composites," 49(12) J. Appl. Phys., December 1978, 6031–6038; Bevk et al., "High Temperature Strength and Fracture Mode of In-Situ Formed Cu-Nb Multifilimentary Composites," in New Developments and Applications in Composites, Proc. TMS-AIME Phys. Metal. Composites Comm. At TMS-AIME Fall Meeting, St. Louis, Mo., Oct. 16–17, 1978, 101–113; Boebinger et al., "Building World-Record Magnets," 272(6) Sci. Amer., June 1995, 34–40. The foregoing articles are incorporated herein by reference.

When manufacturing an in-situ-formed composite by drawing it through a die, many more dislocations are formed than when drawing conventional materials. In fact, while the work hardening rate remains relatively unchanged during the course of drawing for ordinary materials, the work hardening rate increases nearly exponentially as the cross-sectional area of the wire is reduced when drawing in-situ formed composites. As a result of this increase in dislocation formation, much more heat is generated when drawing in-situ composites as compared to more conventional materials.

The present inventors have discovered that for in-situ-formed composites, unlike conventional alloys or composites, the ultimate strength of the dimensionally-reduced material, i.e., wire, strands, rectangular rods, sheets and the like, can be significantly affected by the heating of the material that occurs during size reduction. In particular, to avoid deleterious heating effects that would otherwise occur as a result of the exponential work hardening rate, the drawing speed must be reduced as the material strengthens. The preferred reduced drawing speed can be more than a factor of ten slower than is used in manufacturing wires formed of more conventional materials. If the "work-hardening-limited" drawing speed is exceeded, then a significant fraction of dislocations are annihilated during passage through the die, reducing the strength and, in some cases, the deformability, of the in-situ-formed composite wire. Furthermore, excess heat will coarsen and break-up the filaments, resulting in additional weakening of the wire. As used herein, the term "deformability" refers to the extent to which the wire can be bent around a small radius without fracturing.

According to the present invention, the temperature of the in-situ-formed composite must be maintained below its recrystallization temperature as it is dimensionally reduced. In the case of wire manufacture utilizing a drawing process, the temperature of the in-situ-formed composite wire is a function of the drawing speed, the reduction in cross-sectional area across the die or dies (the reduction ratio), the die angle, lubrication and the amount of coolant, if any, delivered to the wire. These parameters may be adjusted separately or in combination to keep the temperature of the in-situ-formed composite wire below its recrystallization temperature.

BRIEF DESCRIPTION OF THE DRAWINGS

The present invention will become more apparent from the following detailed description of specific embodiments thereof when read in conjunction with the accompanying drawings, in which like elements have like reference numbers and in which.

DETAILED DESCRIPTION OF THE PREFERRED EMBODIMENTS

Figure 1:
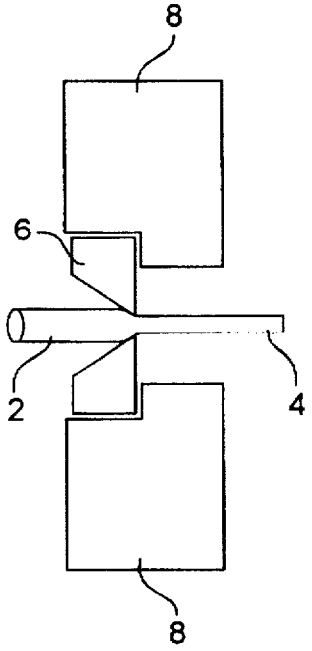
FIG. 1 (PRIOR ART)
FIG. 1 is a simplified illustration of a conventional wire-drawing process.

FIG. 1 is a simplified representation of a conventional arrangement 1 for drawing wire or the like. In the arrangement shown, a feed wire 2 is reduced in cross section by forcing it through a die 6, resulting in a drawn wire 4. Typically, the feed wire 2 is forced through the die 6 by applying a drawing force to the drawn wire 4. The die 6 is retained by a die holder 8. The reduction ratio of the die 6 is defined as the fractional reduction in the wire's cross sectional area as it is drawn through the die.

Figure 2:
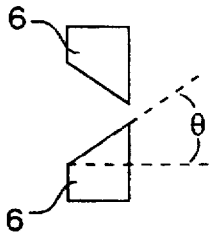
FIG. 2 (PRIOR ART)
FIG. 2 is an illustration of a die showing the die angle.
Figure 3:
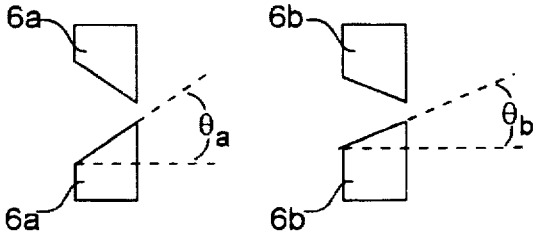
FIG. 3 (PRIOR ART)
FIG. 3 is a comparison of two dies having different die angles.

The die is characterized as having a die angle, θ, as shown in FIG. 2. FIG. 3 illustrates a die 6*a* possessing a relatively larger die angle, $\theta_a$, and a die 6*b* possessing a relatively smaller die angle, $\theta_b$. Lubricants, such as oils or soaps may be used to reduce the friction on the wire 2 as it is drawn through the die 6.

Such a wire-drawing arrangement 1 can be used to draw conventional materials such as copper, or the in-situ-formed composites to which the present invention is directed. Typical examples of in-situ-formed composites include, without limitation, iron (Fe), niobium (Nb), vanadium (V), silver (Ag) or tantalum (Ta) filaments dispersed within either a copper (Cu) or silver (Ag) matrix. Note, however, that a silver-silver composite can not be formed. Typically, the highest strength in-situ composites will be formed when the filaments and the matrix have a different crystalline structure. For example, copper-niobium combines a face-centered-cubic (fcc) copper matrix with body-centered-cubic (bcc) niobium filaments.

While both conventional materials and in-situ-formed composites can be drawn by the same arrangement 1, the manner in which these materials are drawn differs according to the present invention.

Conventional materials, such as copper, can be drawn through the arrangement 1 at a rate limited only by the strength of the wire, as previously described. According to the present invention, in order to produce maximum strength in-situ-formed composite materials, the rate at which such materials are drawn is limited by the heat generated during the drawing process. In particular, to avoid deleterious heating effects, the temperature of the in-situ-formed composite should not exceed its recrystallization temperature, $T_{RC}$, as it is being drawn. In comparison with in-situ composites drawn at a conventional (fast) drawing rate, composites drawn according to the present invention may realize a greater deformability, a greater tensile strength, or both.

The recrystallization temperature is defined as the temperature at which a significant number of the dislocations present in the matrix begin to annihilate each other. The recrystallization temperature may be determined by measuring resistivity as a function of temperature for an in-situ composite wire. A drop in resistivity occurs at $T_{RC}$. This is described in Karasek et al., "Normal-State Resistivity of In-Situ-Formed Ultrafine Filamentary Cu-Nb Composites," pp. 1371–72, supra. FIG. 2 of Karasek et al. shows a plot of resistivity versus temperature for a 61 micron diameter wire formed of a Cu—Nb in-situ composite containing 15.0 volume percent niobium. According to the discussion accompanying FIG. 2, a transition to the lower curve, i.e., the recrystallization temperature, was observed at about 523K (250° C.) or higher. The recrystallization temperature is different for different composites, e.g., Cu—Nb vs. Cu—V as well as for different filament compositions, e.g., Cu—Nb containing 7.5 volume percent Nb vs. Cu—Nb containing 10 volume percent Nb. In addition, $T_{RC}$ decreases with an increase in dislocation density. Thus, given a feed wire 2, the recrystallization temperature will vary with the amount that the cross section is reduced during drawing (since dislocation density increases with a decrease in wire cross section). The aformentioned decrease in $T_{RC}$ with decreasing cross section has important processing implications when in-situ composite wire is drawn through a series of dies, as discussed in more detail later in this specification.

The primary parameter for controlling the temperature of the composite as it is being drawn is the drawing rate. Decreasing the drawing rate will decrease heat generation. Secondary and tertiary parameters affecting heat generation and hence wire temperature include the reduction ratio of the die, the die angle, lubrication and cooling. A decrease in the reduction ratio of the die will decrease heat generation and hence provide a measure of temperature control. A series of dies with relatively smaller reduction ratios capable of achieving an overall reduction, R, in cross-sectional area, may be used in preference to a single die capable of achieving the same reduction, R, as described below.

Figure 4:
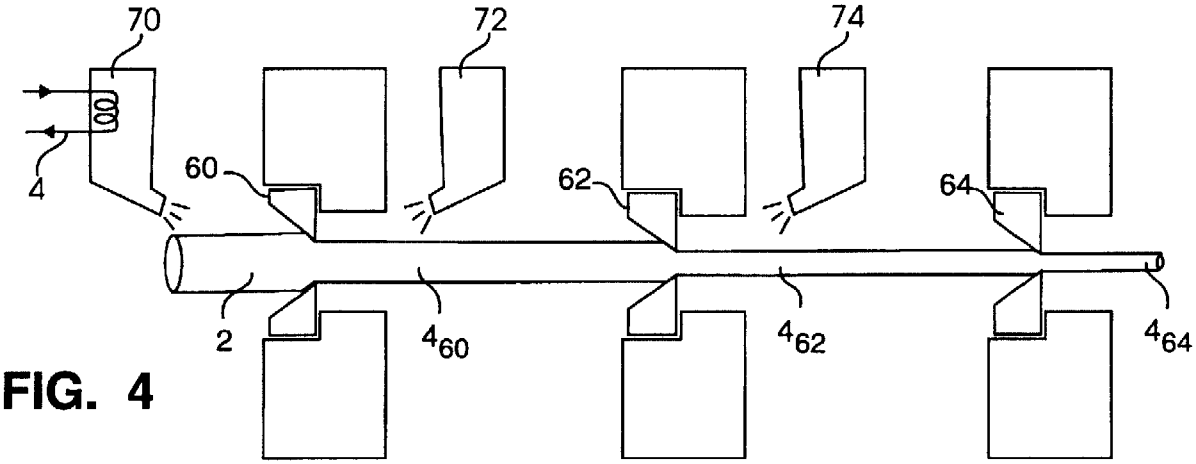
FIG. 4 shows an arrangement for wire drawing having three dies and coolers.

Using a series of dies, such as the dies 60, 62 and 64 shown in FIG. 4, for a step-wise reduction of wire cross section will moderate the rate at which heat is produced and allow for cooling between each die. The ability to cool the wire between each pass through a die, such as the dies 60, 62 and 64, is particularly advantageous. In particular, using multiple dies and inter-die cooling, as indicated by inter-coolers 72 and 74, should allow for a faster drawing rate than using one die capable of the same overall reduction in wire cross section. Inter-die cooling can be effected by spraying lubrication oil or other fluids on the wire.

As previously described, the dislocation density of an in-situ formed composite wire increases nearly exponentially as its cross section is decreased. As such, depending on the reduction ratio of the dies 60, 62 and 64, there may be an increase in the amount of heat generated when drawing through die 62 as compared to die 60, and when drawing through die 64 as compared to die 62. Furthermore, as previously discussed, the recrystallization temperature decreases each time the wire's cross section is reduced through a die. So, in FIG. 4, given a feed wire 2, a drawn wire 460 drawn through die 60, a drawn wire 462 drawn through die 62 and a drawn wire $4_{64}$ drawn through die 64:

$$T_{RC} \text{ of } 2 > T_{RC} \text{ of } 4_{60} > T_{RC} \text{ of } 4_{62} > T_{RC} \text{ of } 4_{64};$$

Thus, as the wire is passed successively through the dies 60, 62 and 64 an increasing amount of heat may be generated and a sequential decrease in the recrystallization temperature occurs. As such, an increase in cooling may be required after die 62 compared with die 60 and after die 64 compared with die 62.

As mentioned above, reducing the die angle will also reduce the heat generated as the composite is passed through the die 6. Lubricants such as soaps or oils may reduce frictional heating and also provide cooling. Furthermore, minimizing the temperature of the feed wire 2 to the die is preferable. In a preferred embodiment, the feed temperature is about room temperature or less. Thus, in a preferred embodiment, a precooler 70 is used to cool the feed wire 2.

Figure 5:
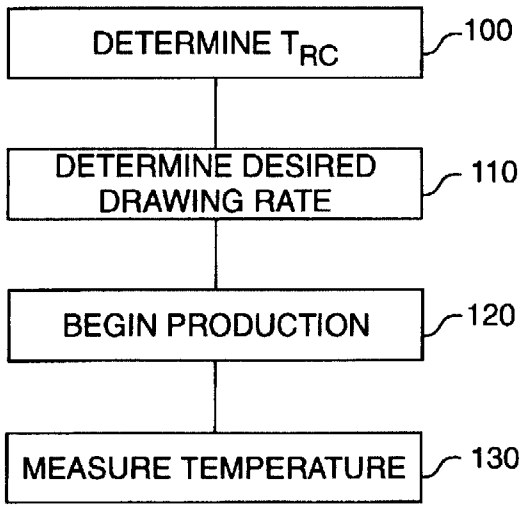
FIG. 5 is a flow diagram of an embodiment of a method according to the present invention.

A preferred embodiment of a process according to the present invention is illustrated by the flow diagram in FIG. 5. As indicated in operation block 100, the recrystallization temperature, $T_{RC}$, is determined for the reduced-cross section wire. If a series of dies are used, such as the dies 60, 62 and 64 of FIG. 4, the $T_{RC}$ is preferably determined for the wire each time its cross section is reduced. So that, referring again to FIG. 4, the $T_{RC}$ of $4_{60}$, $4_{62}$ and $4_{64}$ should be measured. Thus, the in-situ-formed composite wire is first drawn using dies, such as the dies 60, 62 and 64, that will be used during actual production. Samples of the wire at each stage, i.e., each cross section, are obtained and $T_{RC}$ is determined as previously described.

Figure 6:
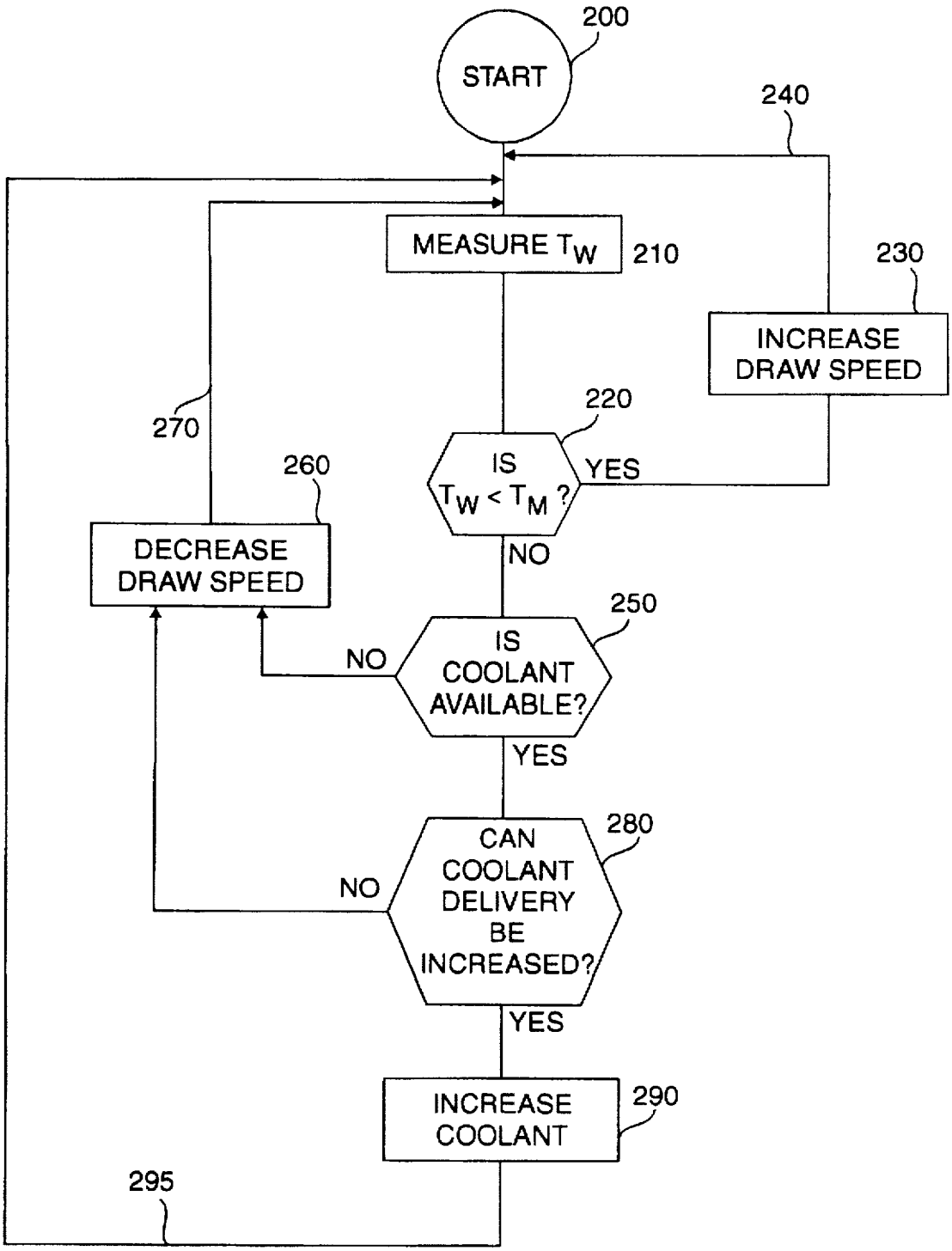
FIG. 6 is a flow diagram illustrating an embodiment for determining maximum drawing speed.

The desired drawing speed is then determined, as indicated in operation block 110. Since manufacturing costs are usually minimized by maximizing production rate, the desired drawing speed will typically be the maximum allowable drawing speed. The maximum drawing speed can be determined according to the exemplary embodiment shown in FIG. 6.

The same arrangement of dies that were used in the determination of $T_{RC}$ are preferably used for determining maximum drawing speed. As indicated in operation block 200, drawing begins. The temperature of the wire, $T_W$, is measured each time its cross section is reduced, i.e., after passage through a die, as noted in operation block 210. In decision block 220, $T_W$ is compared to a maximum allowable temperature, $T_M$, which can be $T_{RC}$, or $T_{RC}$ minus some small offset, e.g., $T_{RC}$—10 degrees. If $T_W<T_M$, then drawing speed is increased in operation block 230. Loop back 240 indicates iterative processing so that steps 210 and 220 are repeated.

With the continuing increase in drawing speed, wire temperature will increase until $T_W>T_M$. When this occurs, "flow" proceeds from decision block 220 to decision block 250. Decision block 250 queries whether or not coolant is available. If coolant is not available, wire drawing speed is reduced as indicated in operation block 260, and followed by iterative processing due to loop back 270. Maximum drawing speed can then be determined by a few more cycles through steps 210–270.

If coolant is available, decision block 280 queries whether or not coolant is being delivered to the wire at the maximum rate. If it is, then drawing speed is decreased as indicated in operation block 260, and, with a few more iterations, maximum drawing speed is determined. If additional cooling is available, cooling is increased in step 290. Loop back 295 indicates iterative processing.

If a multiple die arrangement is used, there will be a $T_W$ and a $T_M$ corresponding to each cross section reduction. Typically, one of the dies will limit the drawing speed. More properly, the resulting $T_W$ and $T_M$ of the wire after passage through such a die will limit the drawing speed. It will be appreciated that the aforementioned method assumes fixed die parameters, i.e., reduction ratio and die angle. The above steps can be repeated for other sets of dies having other reduction ratios and/or die angles. Using such other die sets will typically result in a different maximum drawing rate. Thus, by parametric variation of die parameters, and utilizing the exemplary processing steps illustrated in FIG. 6, a maximum drawing speed can be determined for a particular application.

Returning now to the exemplary method illustrated in FIG. 5, regular production can begin according to the above-determined parameters, as indicated in operation block 120. Optionally, temperature can be periodically checked, as indicated in operation block 130, to ensure that wire temperature remains below the maximum allowable temperature, $T_M$, after each reduction in wire cross section.

Figure 7:
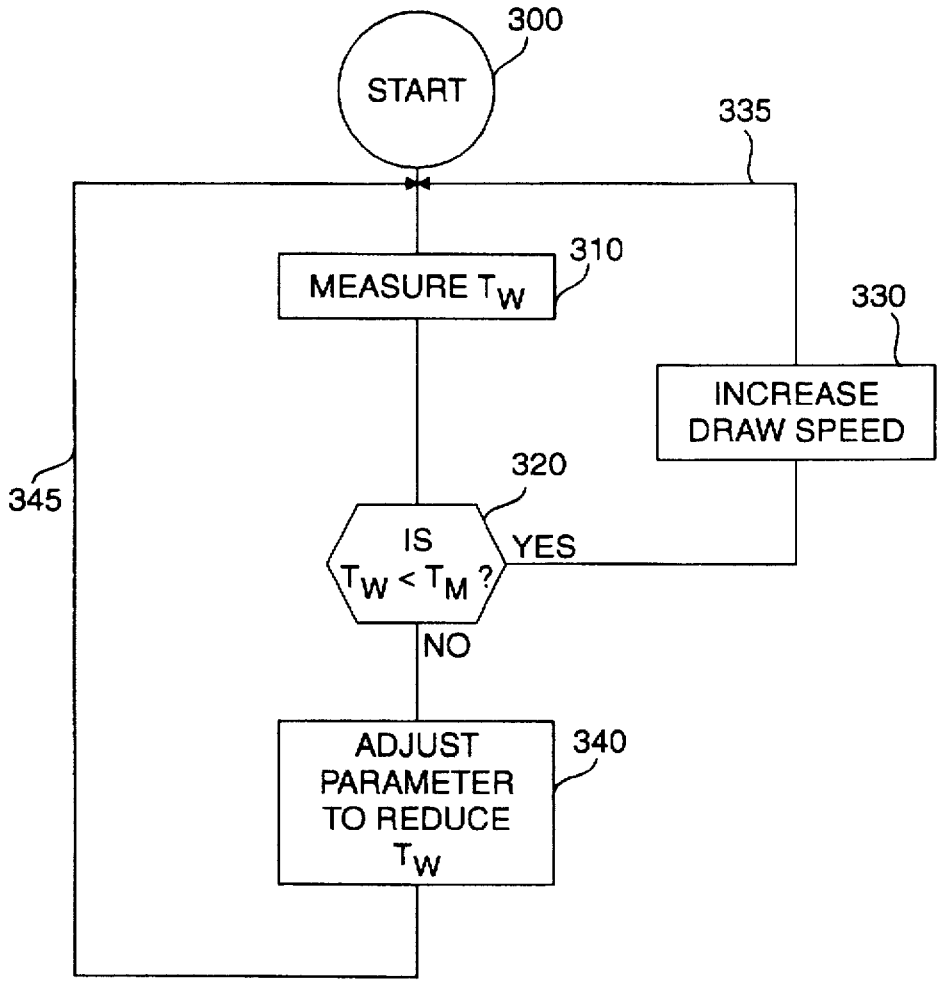
FIG. 7 illustrates a further embodiment of a method according to the present invention.

It will be appreciated that various modifications can be made to the above-described method. For example, in one embodiment, the maximum drawing speed does not need to be determined before beginning regular production. Such an embodiment is illustrated by the flow diagram of FIG. 7. The temperature of the wire, $T_W$ is measured after each reduction in cross section, as indicated in operation block 310. In decision block 320, Tw is compared to $T_M$. If $T_W<T_M$, then the drawing speed is increased in operation block 330. Loop back 335 indicates iterative processing so that steps 310 and 320 are repeated.

With the continuing increase in drawing speed, wire temperature will increase until $T_W>T_M$. When this occurs, a parameter of the drawing process, such as coolant flow or drawing speed, should be adjusted to reduce $T_W$. Loop back 345 indicates iterative processing. The embodiment illustrated in FIG. 7 can be implemented by an apparatus using manual temperature measurement and adjustment of process parameters. Alternatively, the embodiment shown in FIG. 7 can be implemented using computer-controlled measurement of temperature and adjustment of operating parameters as described in more detail in conjunction with FIG. 9.

Figure 8:
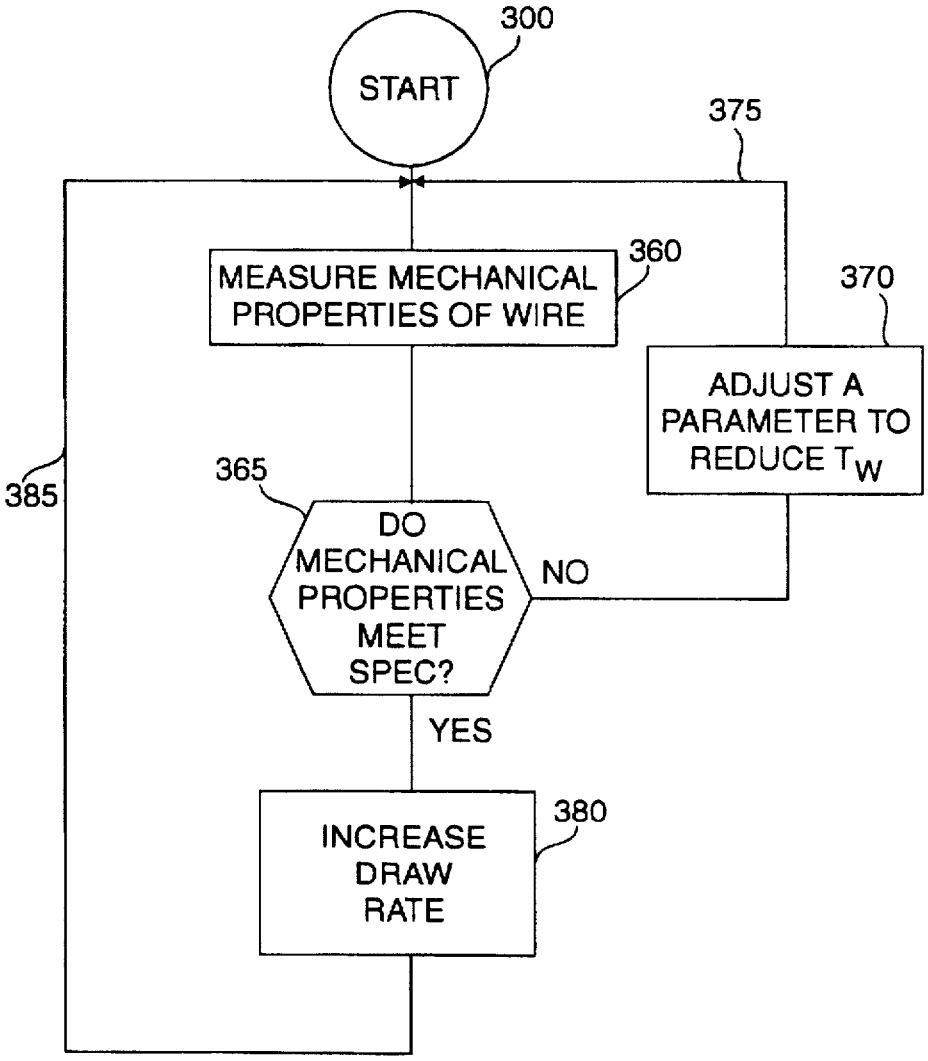
FIG. 8 illustrates an additional embodiment of a method according to the present invention.

In the preferred embodiments described above, the recrystallization temperature is obtained prior to regular production and is used to constrain process variables. In other embodiments, the benefits of the present invention can be obtained without actually determining recrystallization temperature. As previously described, exceeding the recrystallization temperature can dramatically effect the mechanical properties of an in-situ-formed composite material. As such, the process can be operated by measuring the tensile strength and/or deformability of the drawn wire and adjusting process variables, i.e., draw rate, etc., to achieve certain specifications, e.g., minimum acceptable tensile strength and/or deformability. Such an embodiment of the present invention is illustrated in FIG. 8. The embodiment of FIG. 8 is analogous to embodiment of FIG. 7 except that operation block 310 of FIG. 7, measuring $T_W$, is replaced by operation block 360 in FIG. 8. Operation block 360 indicates that properties of the drawn wire are measured.

Wire manufacturers typically seek to maximize wire production rates to maximize their profits. As such, the methods described above are directed toward maximizing the production rate of in-situ-formed composite wire. It should be recognized that there may be other situations in which a manufacturer does not wish to maximize wire production rate. In such a situation, the wire could be drawn at a sufficiently low rate such that there is little chance of exceeding the recrystallization temperature. Thus, in a further embodiment of a method according to the present invention, neither temperature nor other properties of the drawn wire are measured during the drawing process.

Figure 9:
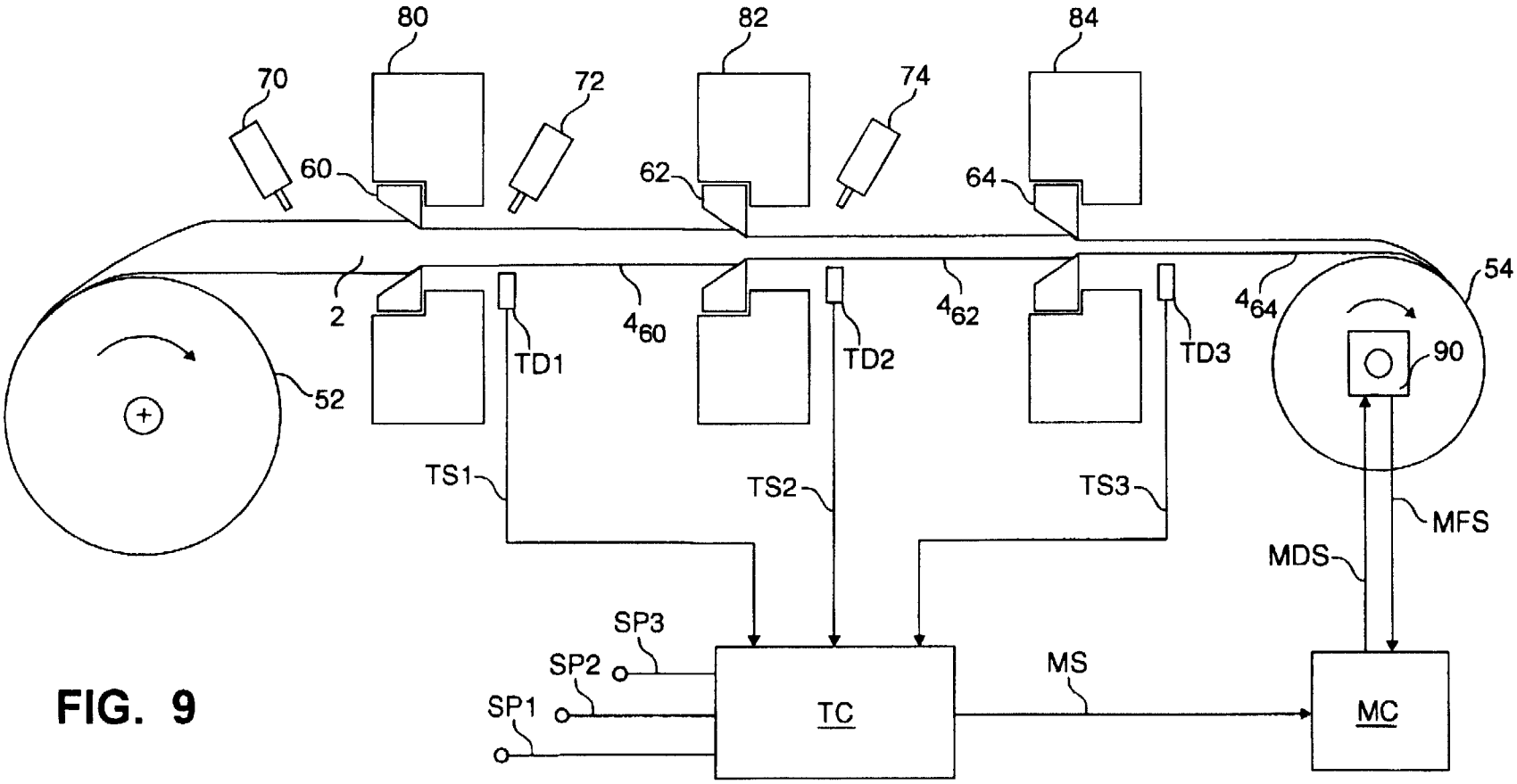
FIG. 9 is an embodiment of an apparatus according to the present invention.

FIG. 9 illustrates an embodiment of a wire-drawing apparatus suitable for drawing insitu-formed composites according to the present invention. The apparatus includes a feed spool 52 which feeds undrawn wire 2 through three dies, 60, 62 and 64 and a take-up spool 54 which receives drawn wire 464 While three dies are shown in the embodiment of FIG. 9, the apparatus may use more or less than three dies. The take-up spool 54 is driven by a motor 90 which supplies a drawing force which draws the wire through the dies. Each die 60, 62 and 64 is received by a respective die-holder 80, 82 and 84.

Each succeeding die reduces the cross section of the wire. Thus, in terms of cross section: $2>4_{60}>4_{62}>4_{64}$. The apparatus shown in FIG. 9 further includes computerized process control that adjusts drawing speed as a function of wire temperature. The process control loop includes temperature measurement devices TD1, TD2 and TD3, temperature controller TC and motor controller MC. The temperature measurement devices TD1–TD3 can be implemented as thermocouples, thermal radiation detectors or other devices known to those skilled in the art. Temperature set points SP1, SP2 and SP3 are input to the temperature controller TC. Those set points set the maximum allowable temperature for the wire in regions 460, 462 and 464, respectively. The set points SP1–SP3 are a function of the work-hardening history of the wire for the aforementioned regions and relate to the recrystallization temperature of the wire in those regions. In particular, the set points may be the recrystallization temperature, or the recrystallization temperature minus some offset.

Thus, each temperature measurement device TD1–TD3 sends a signal, TS1, TS2 and TS3, respectively, to the temperature controller TC. The signals TS1–TS3 relate to the temperature of the wire at the indicated locations. The temperature controller compares each signal with the appropriate set point, e.g., TD1/SP1, TD2/SP2, TD3/SP3. The temperature controller TC then sends a motor speed select signal, MS, to the motor controller MC. If all comparisons show the measured temperatures to be below the corresponding set points, the motor speed select signal MS will direct the motor controller MC to increase the motor speed. This is accomplished by sending an appropriate motor drive signal, MDS to the motor. Alternatively, if one or more of the measured temperatures are above their corresponding set points, then the motor speed select signal MS will direct the motor controller MC to decrease motor speed via an appropriate motor drive signal MDS. The motor control loop may be implemented as a velocity servo loop utilizing a motor speed feedback signal MFS. The design and implementation of process control loops and the like are within the capabilities of those skilled in the art.

The apparatus of FIG. 9 further includes intercoolers 72 and 74. Increasing the cooling provided by the intercoolers will maximize drawing speed. A precooler, 70, may be used to cool the feed wire 2. In the usual case, however, the feed wire will be delivered to the first die at room temperature so that the precooler 70 is not necessary. Furthermore, an aftercooler, not shown, which may be located after the last die can also be included.

In the apparatus of FIG. 9, the coolers 70–74 are not shown to be incorporated in the process control loop. It should be appreciated that in other embodiments, the coolers could be so incorporated. Though, as previously mentioned, the primary temperature control variable is drawing speed.

It should be appreciated that the apparatus of FIG. 9 can be modified to manufacture wire according to the various embodiments of methods of the present invention. For example, on-line process control can be removed and the process can be operated according to pre-determined operating conditions as described in conjunction with FIGS. 5 and 6.

The embodiments of the present invention described above pertain to a drawing process utilizing one or more dies for the manufacture of wire. It will be appreciated by those skilled in the art that in other embodiments, the present invention can be applied to other techniques for cross section reduction, such as, without limitation, swaging or using sets of rollers. Furthermore, the present invention is not limited to manufacturing wires; it is also useful for manufacturing rectangular rods and the like, as well as high-strength sheets of in-situ-formed composite material. In the case of sheet manufacture, a single dimension, e.g., the thickness of a slab of in-situ-formed composite material, is reduced. A pair of rollers can be used for manufacturing such high-strength sheets. It is within the capabilities of those skilled in the art to apply the present teachings to such other embodiments.

A comparison of wire obtained when drawing according to the present invention with wire obtained to conventional methods is presented below. In one case, both wires, which were Cu-Nb in-situ-formed composites, had an ultimate tensile strength of about 165,000 pounds per square inch. The composite drawn using conventional methods, i.e, exceeding the work-hardening heat limitation, was very brittle. That wire, which had a rectangular cross section of 0.076 inches×0.115 inches had a bending radius of ⅜ of an inch when bent in the easy direction. Trying to bend the wire more sharply caused the wire to fracture. Thus, the deformation that the conventionally drawn wire could tolerate during bending was 9 percent. The composite drawn according to the invention, which was drawn to have a larger rectangular cross section (0.140 inches×0.160 inches) achieved the same bending radius of ⅜ of inch. This wire tolerated a deformation of 16 percent during bending, representing an increase in achieveable deformation of over 75 percent for the wire drawn according to the present invention.

In a second comparison, two wires were prepared to have the same deformability. One of the wires was prepared according to conventional methods and the other according to the present invention. The wire drawn according to conventional methods had an ultimate tensile strength of 145,000 pounds per square inch (psi). The ultimate tensile strength of the wire drawn according to the invention was 170,000 pounds per square inch. This represents an increase in strength of 17 percent.

It should be understood that the embodiments described herein are illustrative of the principles of this invention. Various modifications of the present invention may occur to, and be implemented by, those skilled in the art without departing from the scope and spirit of the invention.

We claim:

1. A method for manufacturing an in-situ-formed composite wire from in-situ-formed composite material, wherein the method is characterized by parameters that can affect the temperature of the in-situ-formed composite wire, wherein the in-situ composite material is characterized by a first cross section and wherein the in-situ-formed wire is characterized by a second cross section and further characterized by a recrystallization temperature and mechanical properties comprising tensile strength and deformability, comprising the steps of:

(a) reducing the first cross section of the in-situ-formed composite material to form the in-situ-formed composite wire having the second cross section, wherein heat is generated as the first cross section is reduced in size to the second cross section;

(b) measuring a value of a property of the in-situ-formed composite wire;

(c) comparing the measured value to a predetermined value of the property of the insitu-formed composite wire; and (d) maintaining the temperature of the in-situ-formed composite wire below its recrystallization temperature by adjusting at least one of the parameters if the measured value deviates from the predetermined value such that a reduction in temperature would increase at least one of the mechanical properties.

2. The process of claim 1 wherein the step of reducing comprises drawing the in-situ-formed composite material through a die.

3. The process of claim 1 wherein the property is temperature and the predetermined value is either one of the recrystallization temperature or the recrystallization temperature minus an offset.

4. The process of claim 1 wherein the property is tensile strength and the predetermined value is an acceptable tensile strength.

5. The process of claim 1 wherein the property is deformability and the predetermined value is an acceptable deformability.

6. The process of claim 1 wherein the parameter is the rate at which the in-situ-formed composite material having the second cross section is formed.

7. The process of claim 2 wherein the parameter is the rate at which the in-situ-formed composite material is drawn through the die.

8. The process of claim 2 wherein the die is characterized by a reduction ratio, and the parameter is the reduction ratio of the die.

9. The process of claim 2 wherein the die is characterized by a die angle, and the parameter is the die angle.

10. The process of claim 1 wherein the parameter is selected from the group consisting of the amount of lubrication and the amount of coolant.

11. The process of claim 1 wherein the in-situ-formed composite has a matrix material and a filamentary material, wherein the matrix material is selected from the group consisting of copper and silver, and the filamentary material is selected from the group consisting of iron, niobium, vanadium, silver and tantalum, with the proviso that the matrix and the filamentary material in a in-situ-formed composite both cannot be silver.

12. A method for manufacturing an in-situ formed multifilamentary composite wire from a composite material by drawing the composite material through a die to reduce its cross section, wherein the wire is characterized by a recrystallization temperature, comprising the steps of:

(a) determining the recrystallization temperature of the in-situ-formed multifilamentary composite wire;

(b) determining a desired drawing rate of the composite material, wherein the desired drawing rate is such that the temperature of the in-situ-formed multifilamentary wire being manufactured is less than its recrystallization temperature; and (c) reducing the cross section of the composite material by drawing it through the die at the rate determined in step (b).

13. The method of claim 12 wherein recrystallization temperature is determined by:

(i) reducing the cross section of the in-situ-formed composite material;

(ii) measuring the resistivity of the reduced-cross section material formed in step (i) at a plurality of temperatures;

(iii) generating a resistivity relation by expressing the resistivity measurements obtained in step (ii) as a function of temperature; and (iv) determining recrystallization temperature from the resistivity relation.

14. The method of claim 12 wherein the desired drawing rate is the maximum rate at which the in-situ-formed composite wire can be drawn while keeping the temperature of the in-situ-formed composite wire below its recrystallization temperature.

15. A method for reducing at least one dimension of a composite material to form an in-situ formed multifilamentary composite wire, wherein the in-situ-formed multifilamentary composite is characterized by a temperature and a recrystallization temperature, comprising the steps of:

(a) providing a device suitable for reducing the one dimension of the composite material; and (b) reducing the one dimension of the composite material by processing the composite material with the device at a rate such that the temperature does not equal or exceed the recrystallization temperature of the in-situ formed multifilamentary composite material.

16. The method of claim 15 wherein the one dimension is the thickness of the in-situ-formed composite material.

17. The method of claim 15 wherein step (a) comprises providing a device suitable for reducing two dimensions of the in-situ-formed composite material and step (b) further comprises reducing two dimensions of the in-situ-formed composite material at a rate such that the temperature does not equal or exceed the recrystallization temperature of the dimensionally-reduced material.

18. An apparatus for reducing the cross section of an in-situ-formed composite material, comprising:

a material-supply spool for supplying the composite material;

a first die received by a first die holder, the first die defining a first opening that is smaller than the cross section of the supplied composite material;

a take-up spool for receiving the reduced-cross section composite material;

a motor connected to the take-up spool, wherein the motor turns the take-up spool applying a drawing force to the reduced-cross section composite material which draws the supply composite material through the first opening defined by the first die;

a first temperature measurement device for measuring a first temperature of the reduced-cross section composite material and operable to generate a first temperature signal indicative of the first temperature; and a temperature control device operable to receive the first temperature signal and compare the first temperature signal with a first set-point temperature, and further operable to send a first control signal related to the outcome of the comparison to a motor control device, the motor control device operable to receive the first control signal from the temperature control device and send a second control signal to the motor, which second control signal controls the motor speed.

19. The apparatus of claim 18 further comprising:

a second die received by a second die holder, the second die defining a second opening that is smaller than the first opening, wherein, the second die is positioned such that the composite material is drawn through the second opening defined by the second die after it passes through the first opening defined by the first die; and a second temperature measurement device, wherein the second temperature measurement device measures a second temperature of the reduced-cross section composite material after it is drawn through the second die, the second temperature measurement device operable to generate a second temperature signal indicative of the second temperature;

and wherein the temperature controller is operable to receive the second temperature signal and compare it to a second set point temperature.

20. The apparatus of claim 19 further comprising a cooler positioned after the first die and before the second die, the cooler is operable to deliver a coolant to the reduced-cross section composite material.

21. The apparatus of claim 18 wherein the reduced-cross section composite material is characterized by a recrystallization temperature and the first set-point is a value related to the recrystallization temperature.

22. The apparatus of claim 18 wherein the in-situ-formed composite material comprises a matrix material and a filamentary material, wherein the matrix material is selected from the group consisting of copper and silver and the filamentary material is selected from the group consisting of iron, niobium, vanadium, tantalum and silver, with the proviso that in a in-situ-formed composite material the matrix and the filamentary material both cannot be silver.

23. A method for forming a wire comprising the steps of:

providing a two-phase composite material having a precipitate dispersed within a matrix; and generating filaments from the precipitate by dimensionally reducing the two-phase composite material; wherein, the temperature of the composite is maintained below a recrystallization temperature during filament generation.

24. The method of claim 23 wherein, in the step of generating filaments, the rate at which the two-phase composite is dimensionally reduced is controlled to maintain composite temperature below the recrystallization temperature.

25. The method of claim 23 wherein the generated filaments have a thickness in the range of about 50 to 1000 angstroms.

26. The method of claim 23 wherein the step of providing a two-phase composite material comprises providing a precipitate selected from the group consisting of iron, niobium, vanadium, silver and tantalum dispersed in a matrix comprised of an element selected from the group consisting of copper and silver, excluding a silver-silver composite.

27. The method of claim 26 wherein, in the step of providing a two-phase composite, the precipitate has a first crystalline structure and the matrix has a second crystalline structure, wherein the first and second crystalline structures are different.

* * * * *